US010837714B2

(12) United States Patent
Reid et al.

(10) Patent No.: US 10,837,714 B2
(45) Date of Patent: Nov. 17, 2020

(54) HEAT TRANSFER ELEMENTS FOR ROTARY HEAT EXCHANGERS

(71) Applicant: Howden UK Limited, Renfrew (GB)

(72) Inventors: Meron Reid, Renfrewshire (GB); Dougal Hogg, Glasgow (GB)

(73) Assignee: Howden UK Limited, Renfrew (GB)

( * ) Notice: Subject to any disclaimer, the term of this patent is extended or adjusted under 35 U.S.C. 154(b) by 257 days.

(21) Appl. No.: 15/636,673

(22) Filed: Jun. 29, 2017

(65) Prior Publication Data

US 2019/0003778 A1 Jan. 3, 2019

(51) Int. Cl.

| | |
|---|---|
| ***F28D 19/04*** | (2006.01) |
| ***F28F 3/02*** | (2006.01) |
| ***F28F 3/04*** | (2006.01) |
| ***F28F 5/00*** | (2006.01) |
| ***F01K 11/02*** | (2006.01) |

(52) U.S. Cl.

CPC ..... *F28D 19/044* (2013.01); *F28F 3/025* (2013.01); *F28F 3/044* (2013.01); *F28F 3/046* (2013.01); *F28F 5/00* (2013.01); *F01K 11/02* (2013.01)

(58) Field of Classification Search

CPC .... F28D 19/041; F28D 19/042; F28D 19/044; F28D 19/04; F01K 11/02; F28F 5/00; F28F 3/042; F28F 3/044; F28F 3/046

USPC ..... 165/6, 8

See application file for complete search history.

(56) References Cited

U.S. PATENT DOCUMENTS

| | | | | |
|---|---|---|---|---|
| 2,438,851 A | | 3/1948 | Gates | |
| 2,596,642 A | * | 5/1952 | Boestad | F28D 19/042 165/10 |
| 2,940,736 A | * | 6/1960 | Odman | F28D 19/042 165/10 |
| 4,396,058 A | * | 8/1983 | Kurschner | B23P 15/26 165/10 |
| 4,449,573 A | | 5/1984 | Pettersson et al. | |
| 4,553,458 A | | 11/1985 | Schoonover | |
| 4,732,713 A | * | 3/1988 | Korsell | B01J 19/32 165/166 |

(Continued)

FOREIGN PATENT DOCUMENTS

JP H09280761 A 10/1997

OTHER PUBLICATIONS

Notification of Transmittal of International Search Report and Written Opinion, including International Search Report and Written Opinion, for International Application No. PCT/IB/2018/054477 dated Sep. 5, 2018, 15 pages.

*Primary Examiner* — Jianying C Atkisson
*Assistant Examiner* — Jose O Class-Quinones
(74) *Attorney, Agent, or Firm* — Edell, Shapiro & Finnan, LLC

(57) ABSTRACT

A heat transfer element for a rotary heat exchanger includes a plate having a plurality of elongate notches formed therein at spaced intervals and oriented at a first angle relative to a flow direction. The plate further includes a plurality of elongate undulations formed therein at spaced intervals and oriented a second angle relative to the flow direction, wherein the first angle is different than the second angle. A first height of each of said plurality of elongate notches is larger than a second height of each of said plurality of elongate undulations. A plurality of heat transfer elements may be stacked in a container for installation in the rotary heat exchanger.

11 Claims, 8 Drawing Sheets

(56) References Cited

U.S. PATENT DOCUMENTS

| | | | | | |
|---|---|---|---|---|---|
| 4,744,410 | A * | 5/1988 | Groves | F28D 19/044 165/10 |
| 4,838,342 | A | 6/1989 | Goetschius | |
| 4,930,569 | A | 6/1990 | Harder | |
| 4,953,629 | A * | 9/1990 | Karlsson | F28D 19/044 165/10 |
| 5,803,158 | A * | 9/1998 | Harder | F28D 19/044 165/10 |
| 5,836,379 | A * | 11/1998 | Counterman | F28D 19/044 165/10 |
| 5,899,261 | A | 5/1999 | Brzytwa et al. | |
| 6,019,160 | A * | 2/2000 | Chen | F28D 19/044 165/10 |
| 6,179,276 | B1 | 1/2001 | Chen et al. | |
| 6,253,833 | B1 | 7/2001 | Koster et al. | |
| 6,516,871 | B1 | 2/2003 | Brown et al. | |
| 6,892,795 | B1 | 5/2005 | Steele | |
| 8,622,115 | B2 * | 1/2014 | Seebald | F28D 19/044 165/10 |
| 2006/0048521 | A1 | 3/2006 | Katayama et al. | |
| 2009/0250201 | A1 | 10/2009 | Grippe et al. | |
| 2010/0218927 | A1 | 9/2010 | Cooper et al. | |
| 2010/0282437 | A1 | 11/2010 | Birmingham et al. | |
| 2011/0120689 | A1 | 5/2011 | Tsai | |
| 2012/0305217 | A1 | 12/2012 | Cowburn et al. | |
| 2013/0020063 | A1 * | 1/2013 | Fetvedt | F28F 3/04 165/168 |
| 2015/0144293 | A1 * | 5/2015 | Seebald | F28D 19/044 165/7 |
| 2016/0153726 | A1 | 6/2016 | Birmingham et al. | |
| 2017/0102193 | A1 | 4/2017 | Atkinson et al. | |

* cited by examiner

HEAT TRANSFER ELEMENTS FOR ROTARY HEAT EXCHANGERS

TECHNICAL FIELD

Present invention embodiments are related to heat transfer elements for rotary heat exchangers.

BACKGROUND

Conventional coal-fired power plants generate electricity using steam-driven turbines. Coal is burned to heat water in a boiler in order to generate steam. While the efficiency of coal-fired power plants has improved over the years, the process of burning coal results in amounts of particulate matter that can lead to fouling and back-end corrosion of components such as the cold end tiers of heat transfer elements in rotary air preheaters and rotary gas/gas heaters, thereby resulting in costly maintenance. Heretofore, research into such heat exchangers has mainly concentrated on developing heat transfer element profiles compatible with coal-fired boilers and mitigating the problems associated with cold end fouling in particular.

Natural gas is an attractive alternative to coal in terms of thermal efficiency and reduced emissions, but until recently was more expensive and not as readily available as coal. Recent developments in hydraulic fracturing have increased the availability and reduced the cost of natural gas. As a result, many coal-fired boilers are now being converted to natural gas firing. However, components such as rotary heat exchangers originally designed for coal-fired boilers do not take full advantage of the cleaner, lower emission gas flow and higher thermal potential associated with natural or "fracked" gas. Thus, there is a need for improvements in rotary heat exchangers and in the heat transfer elements used therein for clean fuel applications.

SUMMARY OF THE INVENTION

An aspect of the present invention comprises a heat transfer element container for a rotary heat exchanger having a housing with a first opening in fluid communication with a first gas flow and a second opening in fluid communication with a second gas flow, the first and second gas flows having a flow direction. The heat transfer element container comprises a pair of support members defining a space therebetween, and a plurality of heat transfer elements stacked in the space between the pair of support members. At least one of the plurality of heat transfer elements comprises a first plate having a plurality of elongate notches formed therein at spaced intervals and oriented at a first angle relative to the flow direction. The plate further comprises a plurality of elongate undulations formed therein between the notches and oriented at a second angle relative to the flow direction, wherein the first angle is different than the second angle. A first height of each of the plurality of elongate notches is larger than a second height of each of the plurality of elongate undulations.

Embodiments of the present invention may include a plurality of heat transfer elements substantially the same as described above and stacked in an alternating manner between the support members, with adjacent heat transfer elements being of reversed orientation relative to each other to maintain a desired spacing between the elements and to induce turbulence in order to increase heat exchange between the gas flows and the elements. For example, the heat transfer element container may comprise a second heat transfer element including a second plate parallel and adjacent to the first plate and having a plurality of elongate notches formed therein at spaced intervals and a plurality of elongate undulations formed therein between the plurality of elongate notches. The plurality of elongate notches in the second plate may be oriented crosswise relative to the plurality of elongate notches in the first plate to define a spacing between the plates, and the plurality of undulations in the second plate may be oriented crosswise relative to the plurality of undulations in the first plate to induce turbulence in the gas flows in order to improve heat transfer.

Another aspect of the present invention comprises a heat transfer element for a rotary heat exchanger having a flow direction. In an embodiment, the heat transfer element comprises a plate having a plurality of elongate notches formed therein at spaced intervals. The elongate notches are each oriented at a first angle relative to the flow direction and have a first height relative to a surface of the plate. The plate further has a plurality of elongate undulations formed therein at spaced intervals. The elongate undulations are each oriented at a second angle relative to the flow direction and have a second height relative to a surface of the plate. The first height of each of the plurality of elongate notches is larger than the second height of each of the plurality of elongate undulations, and the first angle is different than the second angle.

The configuration of the notches helps maintain a desired spacing between the element and adjacent elements when stacked in a heat transfer element container, and the configuration of the undulations helps induce turbulence in order to increase heat exchange between air or gas and the element.

The inventive heat transfer element and container may enable flue gas exit temperatures from a rotary heat exchanger to be significantly reduced and may result in reduced heat rates, the benefits of which may offset any slight fan power increase needed to deal with the pressure drop due to increased turbulence. When used in a power plant that emits clean flue gas, fouling should be minimal so there should be no tendency for pressure drop drift.

DESCRIPTION OF EXAMPLE EMBODIMENTS

Figure 1:
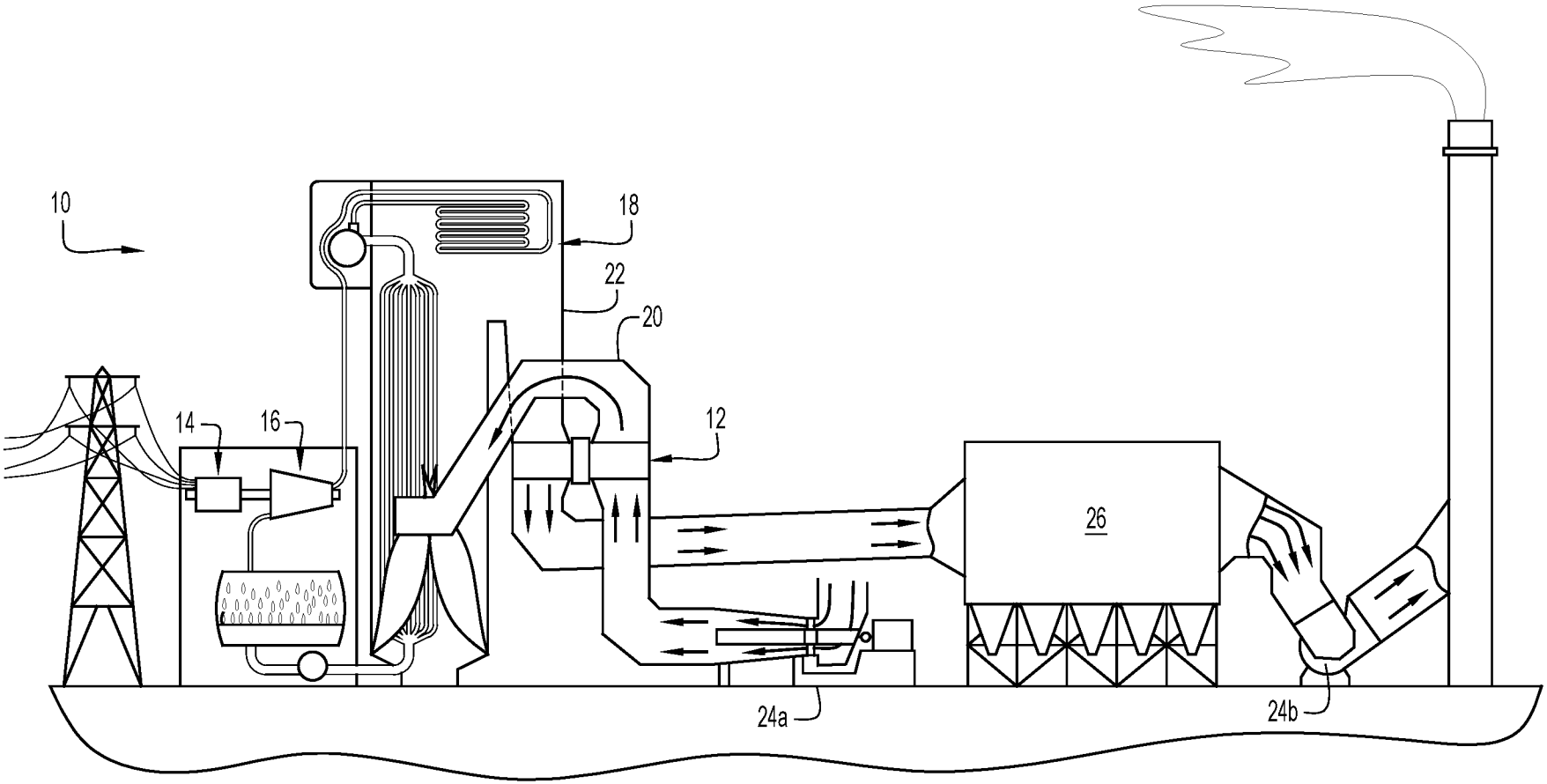
FIG. 1 is a schematic view of a power plant with a rotary heat exchanger that may utilize heat transfer element containers according to an example embodiment of the present invention.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

An example power plant 10 of a type that may incorporate a rotary heat exchanger 12 with heat transfer elements according to the present invention is illustrated in FIG. 1. The power plant 10 includes a generator 14 coupled with a steam turbine 16 to produce electricity. The turbine 16 is driven by steam from a boiler 18, which receives air for combustion via an air intake 20 and expels combustion gases via an exhaust 22. Fans 24*a* and 24*b* may be used to supply air to the boiler intake 20 and to draw combustion gases from the exhaust 22 through a dust removal system 26 before it is released to the atmosphere. A rotary regenerative heat exchanger 12 may be positioned adjacent the air intake 20 and the exhaust 22 to preheat air entering the boiler 18 using heat from combustion gases expelled from the boiler. Rotary regenerative heat exchangers may also be used in gas-gas heaters to control emissions from the plant.

Figure 2:
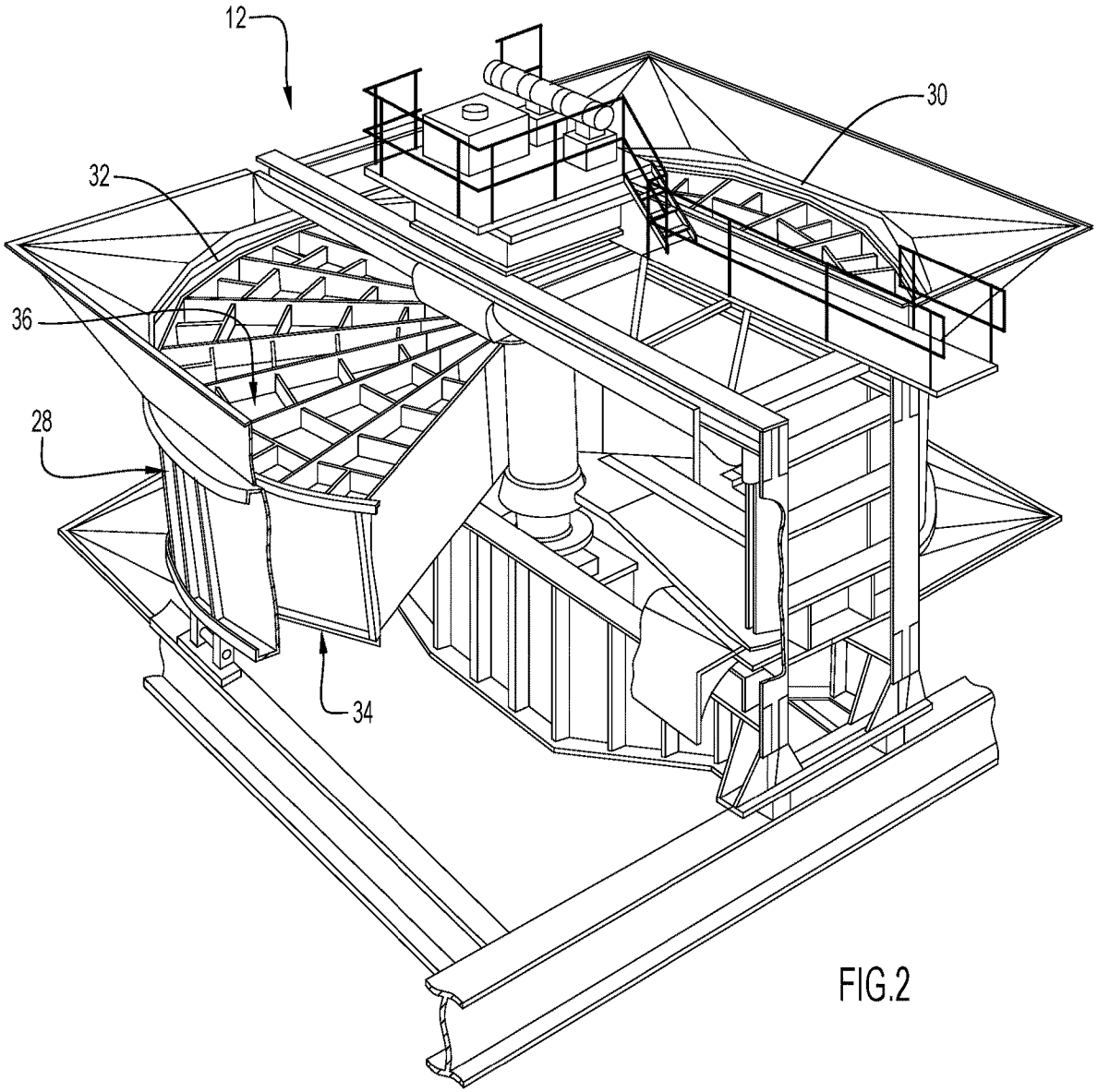
FIG. 2 is a partially cut-away perspective view of a rotary heat exchanger of a type that may use heat transfer element containers according to an example embodiment of the present invention.

Referring now to FIG. 2, a partially cut-away perspective view of a rotary heat exchanger 12 utilizing heat transfer elements and containers according to an example embodiment of the present invention is shown. The rotary heat exchanger 12 includes a housing 28 with a first duct or opening 30 and a second duct or opening 32. The first opening 30 communicates with the boiler air intake 20 and the second opening 32 communicates with the boiler exhaust 22. A rotor 34 containing a plurality of heat transfer element containers 36 is mounted for rotation in the housing 28 such that the heat transfer element containers 36 in the rotor circulate past the openings 30 and 32, thus causing heat transfer elements in the containers to be heated by exhaust gases when aligned with the second opening and preheating incoming air when aligned with the first opening.

Figure 3:
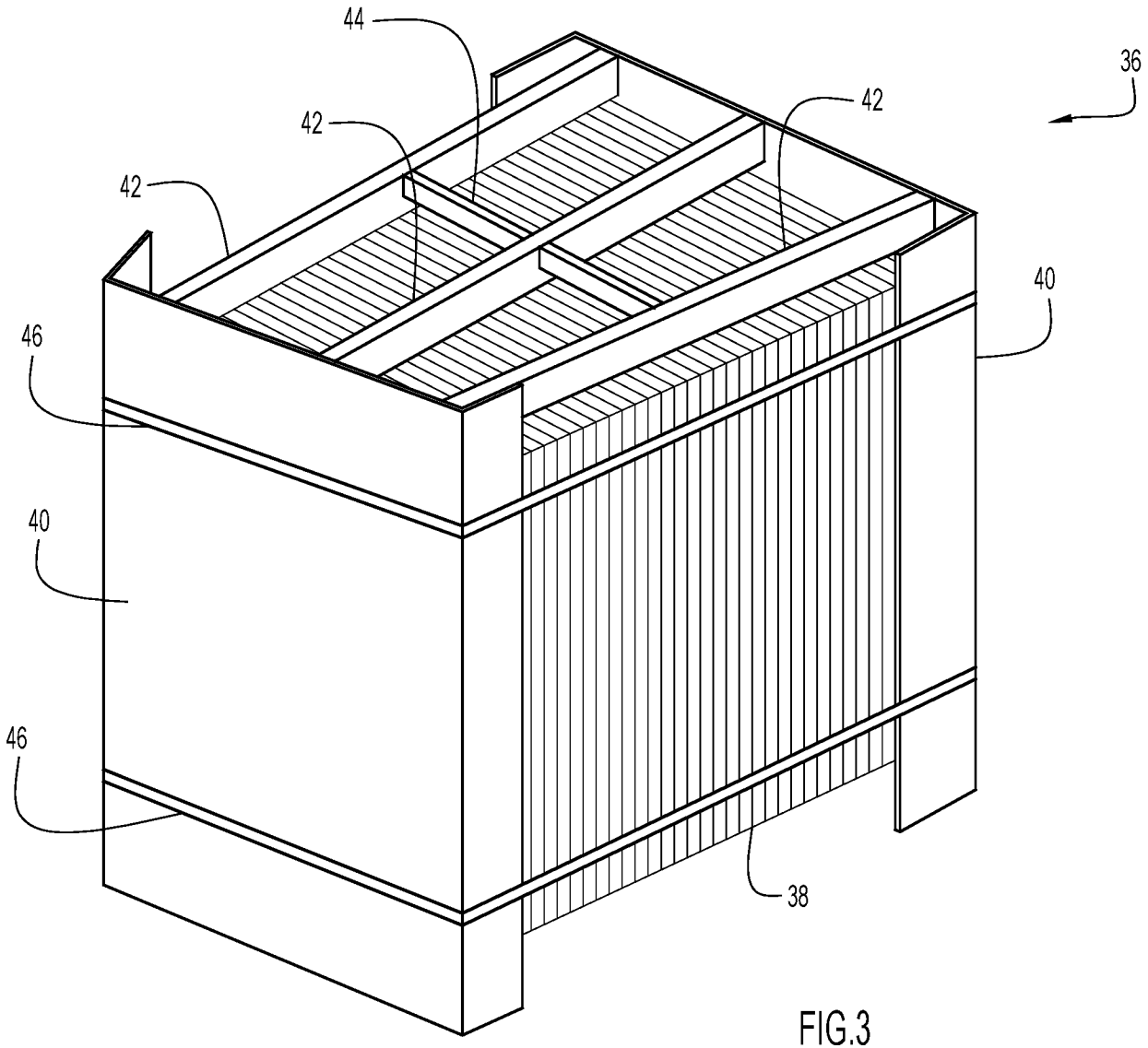
FIG. 3 is a perspective view of a heat transfer element container for a rotary heat exchanger according to an example embodiment of the present invention.

FIG. 3 is a perspective view of a heat transfer element container or pack 36 for a rotary heat exchanger according to an example embodiment of the present invention. The heat transfer element container 36 includes a plurality of heat transfer elements 38 in the form of sheets or plates arranged in a stack between a pair of support members 40. In an example embodiment, the support members may be end plates. In the example shown, the sheets are rectangular sheets oriented vertically between horizontally spaced end plates. The sheets are of the same height and of increasing width in a horizontal direction to provide a trapezoidal cross-section when viewed from above. The trapezoidal shape of the container 36 in this example permits multiple containers of this type to be arranged in a circular pattern or ring within a rotor of a rotary heat exchanger. The example heat transfer element container 36 may also include one or more support bars 42 extending above and below the heat transfer elements 38 between the support members 40 to help provide structural support for the assembly and/or one or more stiffening bars 44 extending transversely across the one or more support bars 42 for additional support. One or more steel bands 46 may be wrapped around the assembly to help retain the elements 38 in position during transportation. Any of the heat transfer elements described herein may be used in such a container.

Figure 4:
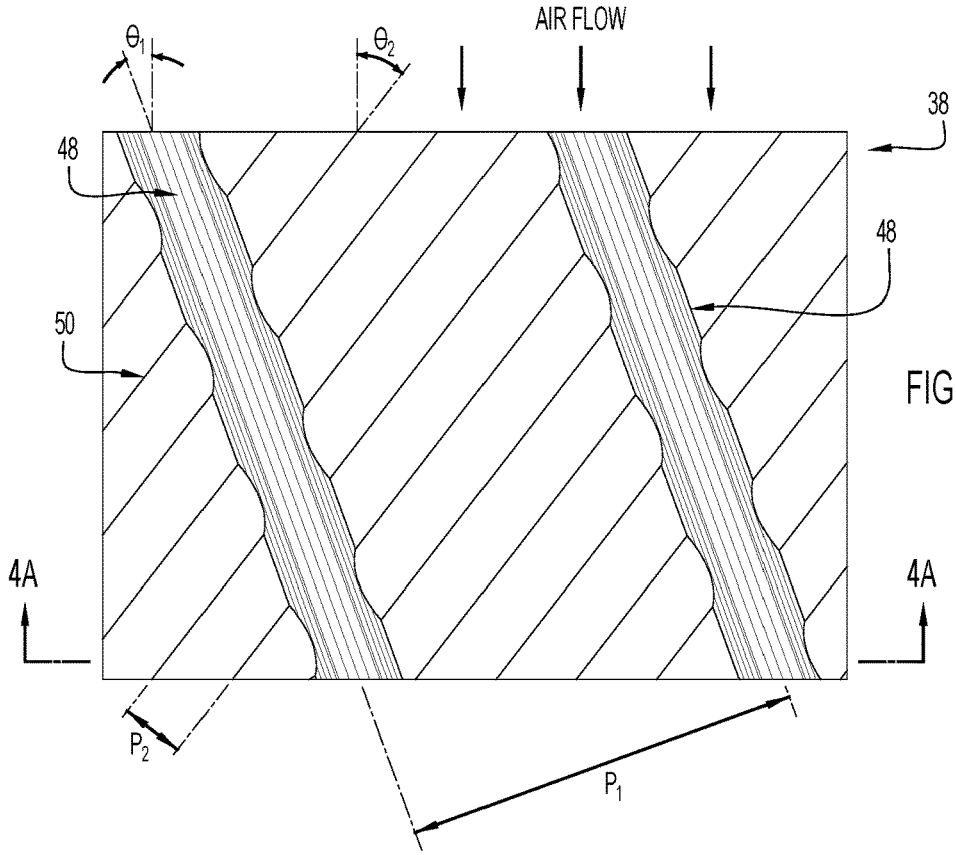
FIG. 4 is a planar view of a heat transfer element according to an example embodiment of the present invention.
Figure 4A:
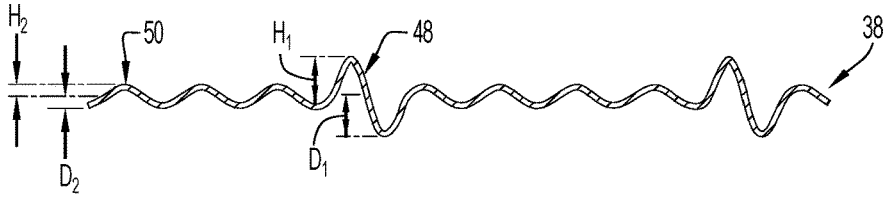
FIG. 4A is a cross-sectional view of the heat transfer element of FIG. 4 taken through section 4A-4A.

FIG. 4 is a planar view of a heat transfer element 38 according to an example embodiment of the present invention. The heat transfer element 38 comprises a rectangular sheet or plate formed of a thermally conductive material, such as steels, that can withstand being repeatedly heated to high temperatures when exposed to exhaust gases and cooled when exposed to incoming air at ambient temperature. A plurality of ribs or notches 48 are formed in the sheet at a first angle $\Theta_1$ relative to the direction of air or gas flowing through the heat transfer element container (e.g., by feeding sheet stock through a pair of rollers with notched profiles). The notches 48 may be parallel as shown, with a first pitch $P_1$ between notches. While two notches 48 are shown by way of example, it will be appreciated that the heat transfer element may be formed with more than two notches. As best seen in the cross-sectional view of the heat transfer element 38 shown in FIG. 4A, each notch 48 has a peak with a first height $H_1$ and a trough with a first depth $D_1$, which are selected to establish a desired spacing between stacked elements. The spacing between stacked elements is chosen to define a channel through which air and/or exhaust gases can flow.

A plurality of undulations 50 are also formed in the sheet between the notches 48 (e.g., by feeding sheet stock through a pair of rollers with undulated profiles beforeor simultaneously as the notches are formed). The undulations 50 are configured to induce turbulence in the air and/or gas flowing through the channel defined between adjacent heat transfer elements 38. The undulations 50 are oriented at a second angle $\Theta_2$ relative to the direction of air or gas flowing through the heat transfer element container. In the example heat transfer element shown in FIG. 4, the second angle $\Theta_2$ is selected to be in a direction opposite the first angle $\Theta_1$ relative to the flow direction (e.g., clockwise vs. counterclockwise) so that the undulations 50 cross the notches 48. For example, if the first angle is measured counterclockwise from the direction of air/gas flow, the second angle may be measured clockwise from the direction of air/gas flow. The undulations 50 may be parallel to one another as shown, with a second pitch $P_2$ that is smaller than the first pitch $P_1$. As best seen in the cross-sectional view of the heat transfer element 38 shown in FIG. 4A, the undulations 50 may each have a second height $H_2$ that is smaller than the first height $H_1$ and a second depth $D_2$ that is smaller than the first depth $D_1$.

In an example embodiment, the first angle $\Theta_1$ may be in the range of 5° to 45°, and the second angle $\Theta_2$ may be in the range of 0° to −90°. In another example, the first angle $\Theta_1$ may be 20° and the second angle $\Theta_2$ may be −30°. In an example embodiment, the first height $H_1$ and depth $D_1$ may each be 5-9 mm, the second height and depth $H_2$ and $D_2$ may each be 3 mm, the first pitch $P_1$ may be 35 mm, and the second pitch $P_2$ may be 15 mm.

Figure 5:
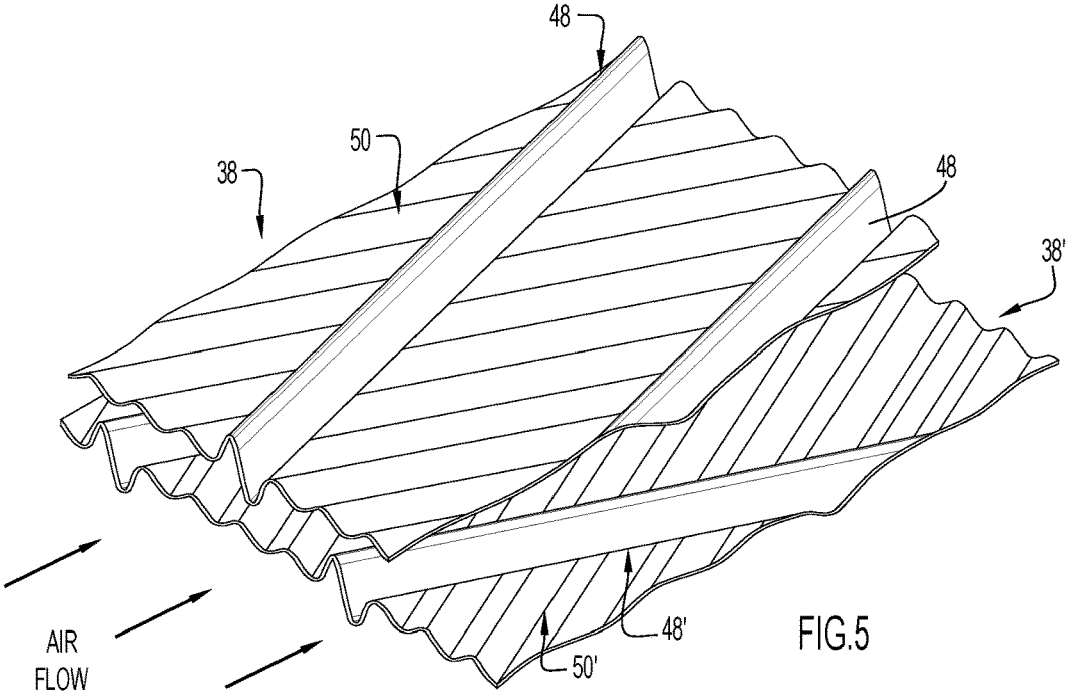
FIG. 5 is a perspective view of adjacent heat transfer elements according to an example embodiment of the present invention.

FIG. 5 is a perspective view of a pair of heat transfer elements 38 and 38' stacked according to an example embodiment of the present invention. The first heat transfer element 38 is shown in partial cutaway so that details of the second heat transfer element 38' can be seen. Both heat transfer elements 38 and 38' have a configuration as shown in FIG. 4. However, their respective orientations relative to the direction of air flow are reversed relative to one another. That is, the first heat transfer element 38 has a first orientation and the second heat transfer element 38' has a second orientation that is rotated 180° relative to the first orientation so that the diagonally spaced notches on one heat transfer element cross the diagonally spaced notches on adjacent heat transfer elements and so on through the stack.

The diagonally spaced crossed notches 48 and 48' perform the function of keeping a desired gap or spacing between adjacent heat transfer elements. The number of notches, their angle and their pitch contribute to having sufficient contact points to achieve a good tight, rigid pack when compressed. The diagonal crossing of the notches 48 and 48' also helps avoid skew flow, keeping an even flow across the full cross sectional flow area of the element pack.

The angled undulations 50 and 50' between the notches in respective heat transfer elements 38 and 38' act as turbulators to induce turbulence. The turbulence inducing angled undulations 50 and 50' are incorporated to improve heat transfer, particularly at lower gas velocities and Reynolds Numbers. High efficiency heat transfer elements of the type described herein are thus suitable for fracked gas firing, in which flue gas exit temperatures may be significantly reduced in comparison with conventional coal fired boilers. The increased pressure drop resulting from higher turbulence is minimal and the heat rate benefits far outweigh any slight fan power increase that may be required. The clean flue gas will also not cause fouling so there is no tendency for pressure drop drift. While two heat transfer elements are shown for purposes of illustration, it will be appreciated that a stack may comprise more than two heat transfer elements of alternating orientation as shown. The heat transfer elements shown in FIG. 5 may be stacked in an alternating manner with each other or with any of the other heat transfer elements described herein.

Figure 6:
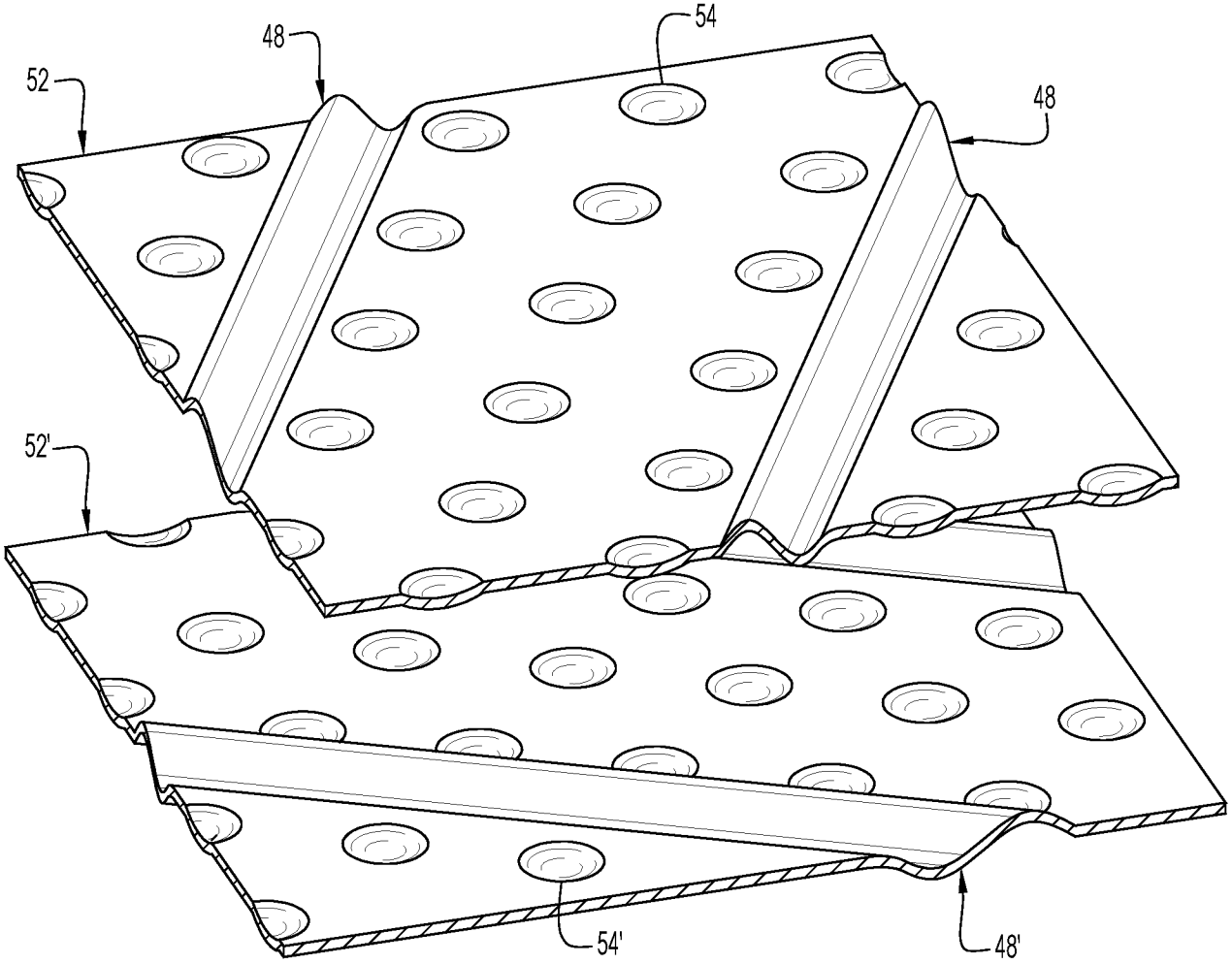
FIG. 6 is a perspective view of adjacent heat transfer elements according to another example embodiment of the present invention.

FIG. 6 is a perspective view of a pair of stacked heat transfer elements 52 and 52' according to another example embodiment of the present invention. The heat transfer elements 52 and 52' are configured the same but are of reversed orientation. Each of the heat transfer elements 52 and 52' includes a plurality of angled notches 48 or 48', respectively, separated by a plurality of dimples 54 or 54', respectively. The angled notches 48 and 48' are the same as described above. However, dimples 54 and 54' are formed in between the notches 48 and 48' (e.g., by feeding sheet stock through a pair of dimpled rollers before or simultaneously as the notches are formed), instead of undulations. In an example embodiment, the dimples 54 and 54' may be hemispherical and either concave or convex. In an example embodiment, two or three rows of dimples are formed between each pair of angled notches. The rows may be parallel to the notches as shown or oriented at an angle relative to the notches. Dimples in adjacent rows may be aligned with each other or staggered. In an example embodiment, the depth of the dimples is less than the height/depth of the notches, and the spacing between adjacent dimples is smaller than the spacing between the notches. Like the undulations, the dimples between the notches act as turbulators to induce turbulence. The turbulence inducing dimples improve heat transfer to facilitate use in fracked gas firing and other applications. Again, while two heat transfer elements are shown for purposes of illustration, it will be appreciated that a stack may comprise more than two heat transfer elements of alternating orientation as shown. The heat transfer elements of FIG. 6 may be stacked in an alternating manner with any of the other heat transfer elements described herein.

Figure 7:
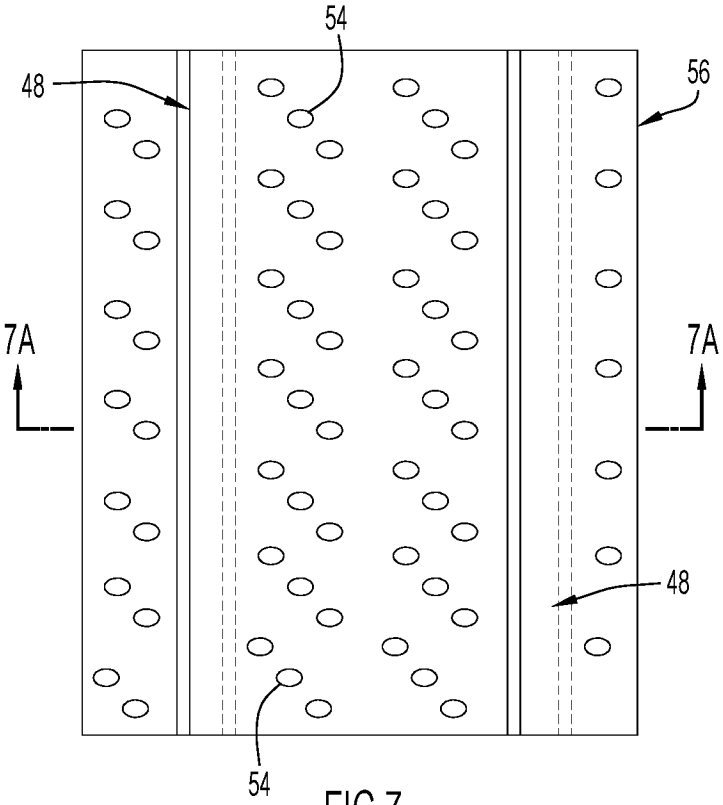
FIG. 7 is a planar view of a heat transfer element according to yet another example embodiment of the present invention.
Figure 7A:
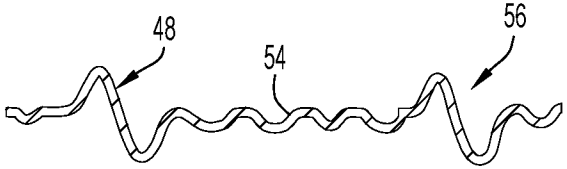
FIG. 7A is a cross-sectional view of the heat transfer element of FIG. 7 taken through section 7A-7A.

FIG. 7 is a planar view of heat transfer element 56 according to yet another example embodiment of the present invention. FIG. 7A is a cross-sectional view of the heat transfer element 56 of FIG. 7 taken through section 7A-7A. The heat transfer element 56 includes a pair of notches 48 oriented parallel to the direction of air flow and a plurality of dimples 54 formed in between the notches. The dimples 54 are arranged in two columns of angled rows, with each row comprising three dimples and being oriented at an angle relative to the direction of air and/or gas flow. In an example embodiment, the rows of dimples 54 are each arranged at an angle of about 45° relative to the direction of air and/or gas flow. Like the heat transfer element of FIG. 6, the dimples in the heat transfer element of FIG. 7 may be hemispherical in shape and may have a depth less than the height/depth of the notches, and a spacing between adjacent dimples that is smaller than the spacing between the notches. The dimples between the notches act as turbulators to induce turbulence. The turbulence inducing dimples improve heat transfer to facilitate use in fracked gas firing and other applications. The heat transfer element of FIG. 7 may be stacked in an alternating manner with the heat transfer element of FIG. 6 or with any of the other heat transfer elements described herein.

Figure 8:
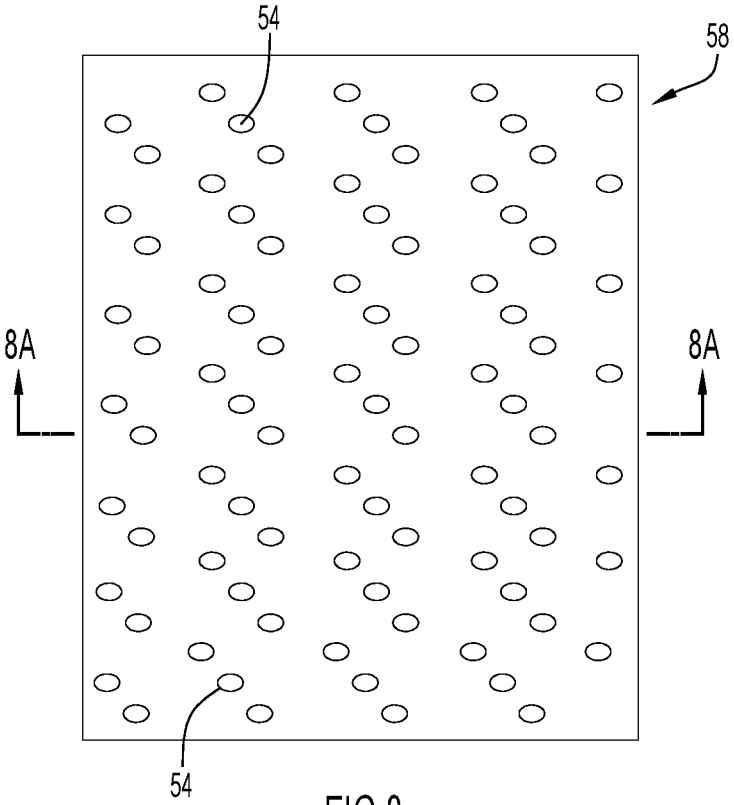
FIG. 8 is a planar view of a heat transfer element according to still another example embodiment of the present invention.
Figure 8A:
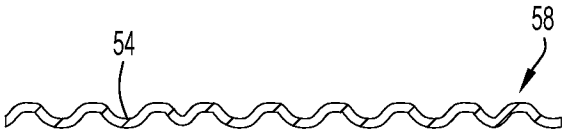
FIG. 8A is a cross-sectional view of the heat transfer element of FIG. 8 taken through section 8A-8A.

FIG. 8 is a planar view of a heat transfer element 58 according to still another example embodiment of the present invention. FIG. 8A is a cross-sectional view of the heat transfer element 58 of FIG. 8 taken through section 8A-8A. In this embodiment, a plurality of dimples 54 are formed in the heat transfer element 58 in a plurality of columns and rows. In an example embodiment, at least three columns of rows comprising three dimples each are shown. However, the rows may contain fewer or more dimples than shown. The rows of dimples are oriented at an angle relative to the direction of air flow. In an example embodiment, the rows of dimples are arranged at an angle of about 45° relative to the direction of air flow. The dimples act as turbulators to induce turbulence. The turbulence inducing dimples improve heat transfer to facilitate use in fracked gas firing and other applications. The heat transfer element of FIG. 8 may be stacked in an alternating manner with the heat transfer element of FIG. 7 or with any of the other heat transfer elements described herein.

Figure 9:
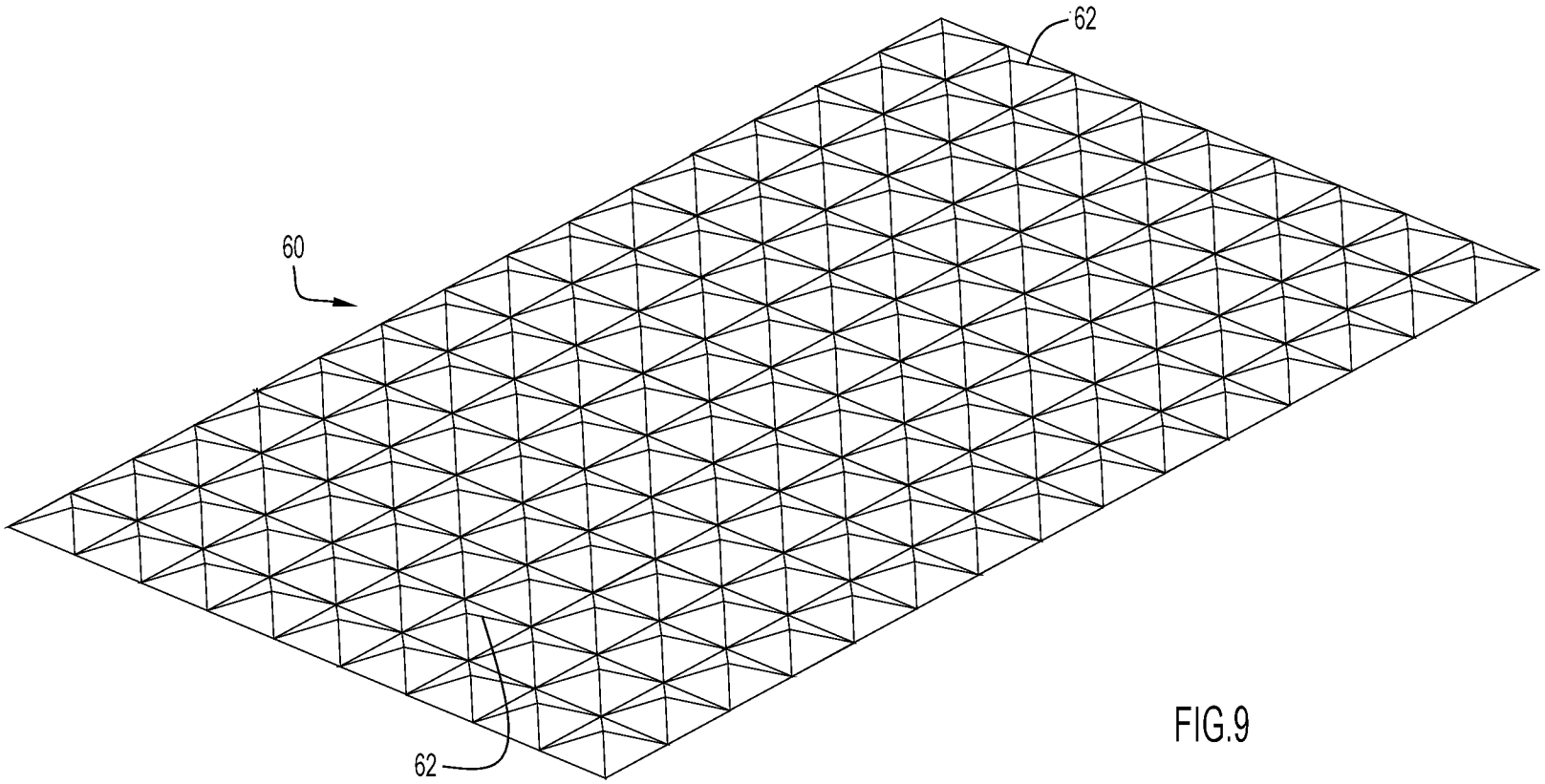
FIG. 9 is a perspective view of a heat transfer element according to a further example embodiment of the present invention.

FIG. 9 is a perspective view of a heat transfer element 60 according to a further example embodiment of the present invention. The heat transfer element 60 of FIG. 9 includes a repeating pattern of diamond shaped bumps or ridges 62 that serve as turbulators to induce turbulence. The turbulence inducing diamond pattern 62 increases the number of contact points and improves heat transfer to facilitate use in fracked gas firing and other applications. The diamond shaped bumps or ridges 62 may be formed by double rolling a sheet with the angle of the undulations on the first roller opposite the angle of the undulations on the second roller. For example, the first roller may be configured to produce undulations oriented at an angle of +30° relative to the direction of air/gas flow and the second roller may be configured to produce undulations oriented at an angle of −30° relative to the direction of air/gas flow. This process results in a diamond profile and the angles of the undulations can be varied to alter the diamond shape. The heat transfer element of FIG. 9 may be stacked in an alternating manner with the heat transfer element of FIG. 7, with a heat transfer element having an undulating or corrugated profile parallel to the direction of air/gas flow, or with any of the other heat transfer elements described herein.

Figure 10:
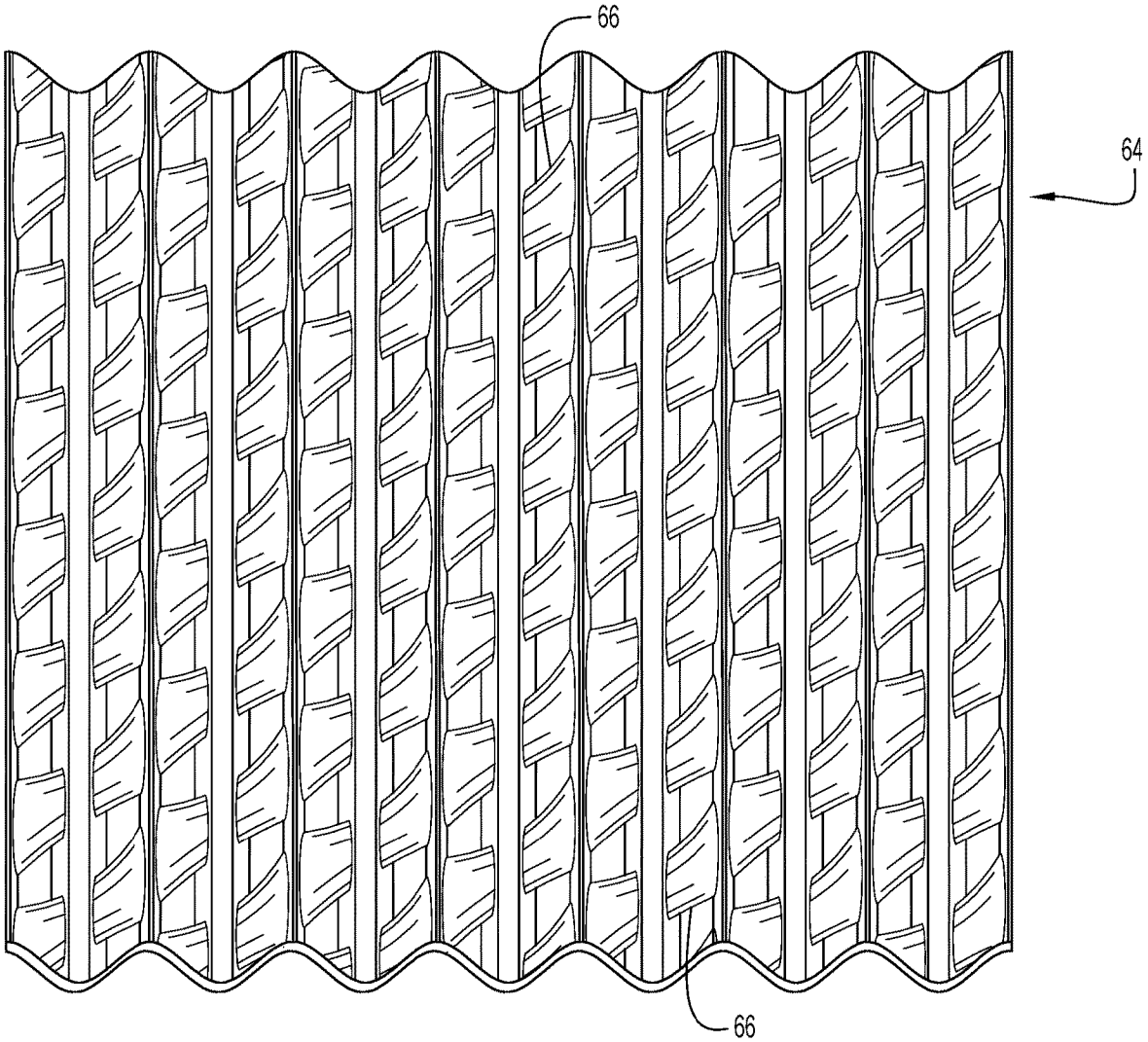
FIG. 10 is a perspective view of a heat transfer element according to an additional example embodiment of the present invention.

FIG. 10 is a perspective view of a heat transfer element 64 according to an additional example embodiment of the present invention. The heat transfer element 64 of FIG. 10 includes a complex pattern of bumps or ridges 66 that serve as turbulators to induce turbulence. The turbulence inducing pattern of FIG. 10 increases the number of contact points and improves heat transfer to facilitate use in fracked gas firing and other applications. The pattern shown in FIG. 10 may be formed by putting a sheet through an undulated roller to produce undulations oriented at an angle relative to the direction of air/gas flow, followed by a corrugated roller that produces corrugations oriented parallel to the direction of air/gas flow. This process creates bumps 66 on the sides of the corrugations to induce turbulence and improve heat transfer. The heat transfer element of FIG. 10 may be stacked in an alternating manner with a heat transfer element having angled undulations (e.g., oriented at an angle opposite the undulations in the heat transfer element of FIG. 10), with the heat transfer element of FIG. 9, or with any of the other heat transfer elements described herein.

It will be appreciated that the embodiments described above and illustrated in the drawings represent only a few of the many ways of implementing embodiments of the present invention. For example, in the embodiment shown in FIG. 4, the angle of the undulations relative to the notch angles and the height of the undulations relative to the notch height can be varied to optimize heat transfer/pressure drop performance depending on the particular application or client specification. Also, while the dimples have been described as being hemispherical, it will be appreciated that they may comprise a smaller spherical segment (e.g., the height or depth of the dimples may be less than the radius) or have other configurations such as a pyramidal shape. Furthermore, while a heat transfer element container having a trapezoidal cross section has been shown, it will be appreciated that the container can be configured to have a rectangular cross-section, a curved cross-section, or any other shape suitable for installation in a rotary heat exchanger.

The invention claimed is:

1. A heat transfer element for a rotary heat exchanger having a flow direction, said heat transfer element comprising:

a plate having a plurality of elongate notches formed therein at spaced intervals, said elongate notches each being oriented at a first angle relative to the flow direction and having a first height relative to a surface of said plate, wherein said first angle is in a range of 5° to 45° relative to the flow direction;

said plate further having a plurality of elongate undulations formed therein at spaced intervals, said elongate undulations each being oriented at a second angle relative to the flow direction and having a second height relative to the surface of said plate, wherein said second angle is in a range of 0° to −90° relative to the flow direction;

wherein said first height of each of said plurality of elongate notches is larger than said second height of each of said plurality of elongate undulations; and wherein said first angle is different than said second angle.

2. A heat transfer element as set forth in claim 1, wherein said first angle is 20° relative to the flow direction.

3. A heat transfer element as set forth in claim 1, wherein said second angle is −30° relative to the flow direction.

4. A heat transfer element as set forth in claim 1, wherein said second height is 20% to 70% of said first height.

5. A heat transfer element as set forth in claim 1, wherein each of said plurality of elongate notches has a first depth relative to said surface of said plate and each of said plurality of undulations has a second depth relative to said surface of said plate, and wherein said second depth is smaller than said first depth.

6. A heat transfer element container for a rotary heat exchanger having a housing with a first opening in fluid communication with a first gas flow and a second opening in fluid communication with a second gas flow, said first and second gas flows each having a flow direction, and said heat transfer element container comprising:

a pair of support members defining a space therebetween;

a plurality of heat transfer elements stacked in said space between said pair of support members, wherein at least one of said plurality of heat transfer elements comprises:

a first plate having a plurality of elongate notches formed therein at spaced intervals, said elongate notches each being oriented at a first angle relative to either of the flow directions and having a first height relative to a surface of said first plate, wherein said first angle is in a range of 5° to 45° relative to either of the flow directions;

said first plate further having a plurality of elongate undulations formed therein at spaced intervals, said elongate undulations each being oriented a second angle relative to either of the flow direction and having a second height relative to the surface of said first plate, wherein said second angle is in a range of 0° to −90° relative to either of the flow directions;

wherein said first height of each of said plurality of elongate notches is larger than said second height of each of said plurality of elongate undulations to define a channel for the first and second gas flows between adjacent heat transfer elements; and wherein said first angle is different than said second angle.

7. A heat transfer element container as set forth in claim 6, wherein said first angle is 20° relative to either of the flow directions.

8. A heat transfer element container as set forth in claim 6, wherein said second angle is −30° relative to either of the flow directions.

9. A heat transfer element container as set forth in claim 6, wherein said second height is 20% to 70% of said first height.

10. A heat transfer element container as set forth in claim 6, wherein each of said plurality of elongate notches has a first depth relative to said surface of said plate and each of said plurality of undulations has a second depth relative to said surface of said plate, and wherein said second depth is smaller than said first depth.

11. A heat transfer element container as set forth in claim 6, wherein at least a second of said plurality of heat transfer elements comprises:

a second plate parallel and adjacent to, and in direct contact with, said first plate and having a plurality of elongate notches formed therein at spaced intervals and a plurality of elongate undulations formed therein between said plurality of elongate notches;

wherein said second plate is rotated 180° relative to said first plate such that said plurality of elongate notches in said second plate are oriented crosswise relative to said plurality of elongate notches in said first plate, and wherein said plurality of undulations in said second plate are oriented crosswise relative to said plurality of undulations in said first plate.

* * * * *